US011178927B2

(12) United States Patent
Suber

(10) Patent No.: US 11,178,927 B2
(45) Date of Patent: Nov. 23, 2021

(54) COLLAPSIBLE ARTIFICIAL TREE

(71) Applicant: Suber Industries, LLC, Columbia, SC (US)

(72) Inventor: Mickey Suber, Columbia, SC (US)

(73) Assignee: Suber Industries, LLC, Columbia, SC (US)

( * ) Notice: Subject to any disclaimer, the term of this patent is extended or adjusted under 35 U.S.C. 154(b) by 0 days.

(21) Appl. No.: 17/209,287

(22) Filed: Mar. 23, 2021

(65) Prior Publication Data

US 2021/0298400 A1 Sep. 30, 2021

Related U.S. Application Data

(60) Provisional application No. 63/003,139, filed on Mar. 31, 2020.

(51) Int. Cl.
*A41G 1/00* (2006.01)
*A47G 33/06* (2006.01)

(52) U.S. Cl.
CPC ..... *A41G 1/007* (2013.01); *A47G 33/06* (2013.01)

(58) Field of Classification Search
CPC ..... A41G 1/007; A47G 33/06
See application file for complete search history.

(56) References Cited

U.S. PATENT DOCUMENTS

| | | | | |
|---|---|---|---|---|
| 843,712 | A | 2/1907 | Straub | |
| 1,590,220 | A | 6/1926 | Waldemar | |
| 3,374,798 | A | 3/1968 | Sigvard | |
| 3,728,202 | A * | 4/1973 | Baus et al. | A47G 33/06 428/12 |
| 3,846,213 | A | 11/1974 | Thiemann | |
| 4,659,597 | A * | 4/1987 | Lau | A47G 33/06 211/196 |
| 4,847,123 | A | 7/1989 | Armstead et al. | |
| 5,015,510 | A | 5/1991 | Smith | |
| 5,712,002 | A * | 1/1998 | Reilly, III | A47G 33/06 211/196 |
| 6,162,515 | A | 12/2000 | Hill | |
| 7,122,230 | B1 | 10/2006 | Maskell | |
| 7,267,852 | B1 | 9/2007 | Rosado et al. | |
| 2010/0196628 | A1 | 8/2010 | Shooley | |
| 2015/0164164 | A1* | 6/2015 | Trotter | A41G 1/007 362/123 |

* cited by examiner

*Primary Examiner* — Adam Krupicka
(74) *Attorney, Agent, or Firm* — Argus Intellectual Enterprise; Jordan Sworen; Daniel Enea

(57) ABSTRACT

A collapsible artificial tree is provided. The collapsible artificial tree includes one or more branch assemblies extending from an elongated trunk, wherein each branch assembly can transition between an extended configuration and a retracted configuration. Each branch assembly includes a scissor arm having a plurality of beam members pivotally linked to one another, wherein the scissor arm is connected to a first and second collar. The first collar and second collar are disposed in a stacked orientation along the trunk, wherein the second collar is slidably engaged with the trunk. As the second collar slides towards the first collar, the branch assembly extends outward from the trunk to the extended configuration. In the retracted configuration, the plurality of beam members is oriented generally vertical to the elongated trunk. These configurations provide for compact storage when not in use and mimicking of a tree structure when in the extended configuration.

18 Claims, 9 Drawing Sheets

COLLAPSIBLE ARTIFICIAL TREE

CROSS REFERENCE TO RELATED APPLICATION

This application claims the benefit of U.S. Provisional Application No. 63/003,139 filed on Mar. 31, 2020. The above identified patent application is herein incorporated by reference in their entirety.

BACKGROUND OF THE INVENTION

The present invention relates to an artificial tree structure. The present invention further provides a collapsible artificial tree that selectively extends and retracts branch assemblies that extend radially from an elongated trunk.

Artificial trees are useful for a variety of reasons, including reducing costs and reducing maintenance that is required for live foliage. Further, artificial trees are desirable for their ability to be compactly stored and reused repeatedly, particularly around the holidays. However, reassembling or erecting artificial branches after a lengthy storage period causes the branches and the structural elements thereof to deform, making it more difficult to have a uniform and aesthetically pleasing tree. Additionally, when storing some artificial trees, a user must manually manipulate each individual limb or branch in order to collapse the entire tree structure and when disassembling some artificial trees require each branch to be removed prior to storage.

Some artificial trees exist having a branch that is pivotally connected to a trunk. However, these artificial tree devices comprise a linear branch wherein the entirety of the greenery is disposed on the linear branch. The linear orientation of each branch requires great force and causes unnecessary strain on the device when transitioning the artificial tree between a stored and an extended configuration. Further, these artificial tree devices require a base having a spring therein to extend all the branches simultaneously. When the spring is compressed and secured in place, the branches are moved downwards into a stored position. However, this movement requires excess user force and a burden to the user if the spring inadvertently expands. Therefore, there exists a need for an artificial tree assembly that easily retracts and expands without the need to manually manipulate each branch thereon or have a spring-loaded base.

In light of the devices disclosed in the known art, it is submitted that the present invention substantially diverges in design elements and methods from the known art and consequently it is clear that there is a need in the art for an improvement for a collapsible artificial tree. In this regard the instant invention substantially fulfills these needs.

SUMMARY OF THE INVENTION

In view of the foregoing disadvantages inherent in the known types of collapsible artificial trees now present in the known art, the present invention provides a new collapsible artificial tree wherein the same can be utilized for conveniently customizing, erecting, and storing an artificial tree.

It is an objective of the present invention to provide a collapsible artificial tree comprising an elongated trunk and one or more branch assemblies positioned at intervals along the trunk, such that the branch assemblies resemble branches of a tree.

It is another objective of the present invention to provide a collapsible artificial tree wherein each branch assembly comprises a first collar and a second collar, wherein the second collar is slidably engaged with the trunk. Each branch assembly further comprises a plurality of beam members pivotally secured to one another via a pivot pin and operably connected to the first and second collar, such that the movement of the second collar along the elongated trunk causes the branch assembly to move between an extended and a retracted configuration.

It is another objective of the present invention to provide a collapsible artificial tree wherein the elongated trunk is adjustable in size in order to receive more or less branch assemblies positioned on the trunk, such that the present invention is modular and customizable.

It is another objective of the present invention to provide a collapsible artificial tree comprising a motor operably connected to the second collar such that a user may remotely operate the branch assembly configurations.

It is yet another objective of the present invention to provide a collapsible artificial tree adapted to allow a user to manually slide all of the second collars simultaneously between the retracted and extended configurations.

It is therefore an object of the present invention to provide a new and improved collapsible artificial tree that has all of the advantages of the known art and none of the disadvantages.

Other objects, features, and advantages of the present invention will become apparent from the following detailed description taken in conjunction with the accompanying drawings.

BRIEF DESCRIPTIONS OF THE DRAWINGS

Although the characteristic features of this invention will be particularly pointed out in the claims, the invention itself and manner in which it may be made and used may be better understood after a review of the following description, taken in connection with the accompanying drawings.

Figure 4:
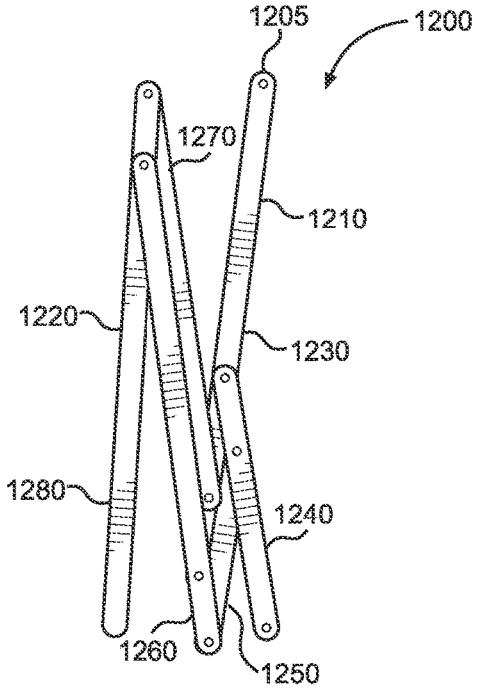

FIG. 4 side a perspective view of a first branch assembly of the collapsible artificial tree in a retracted configuration.

Figure 5:
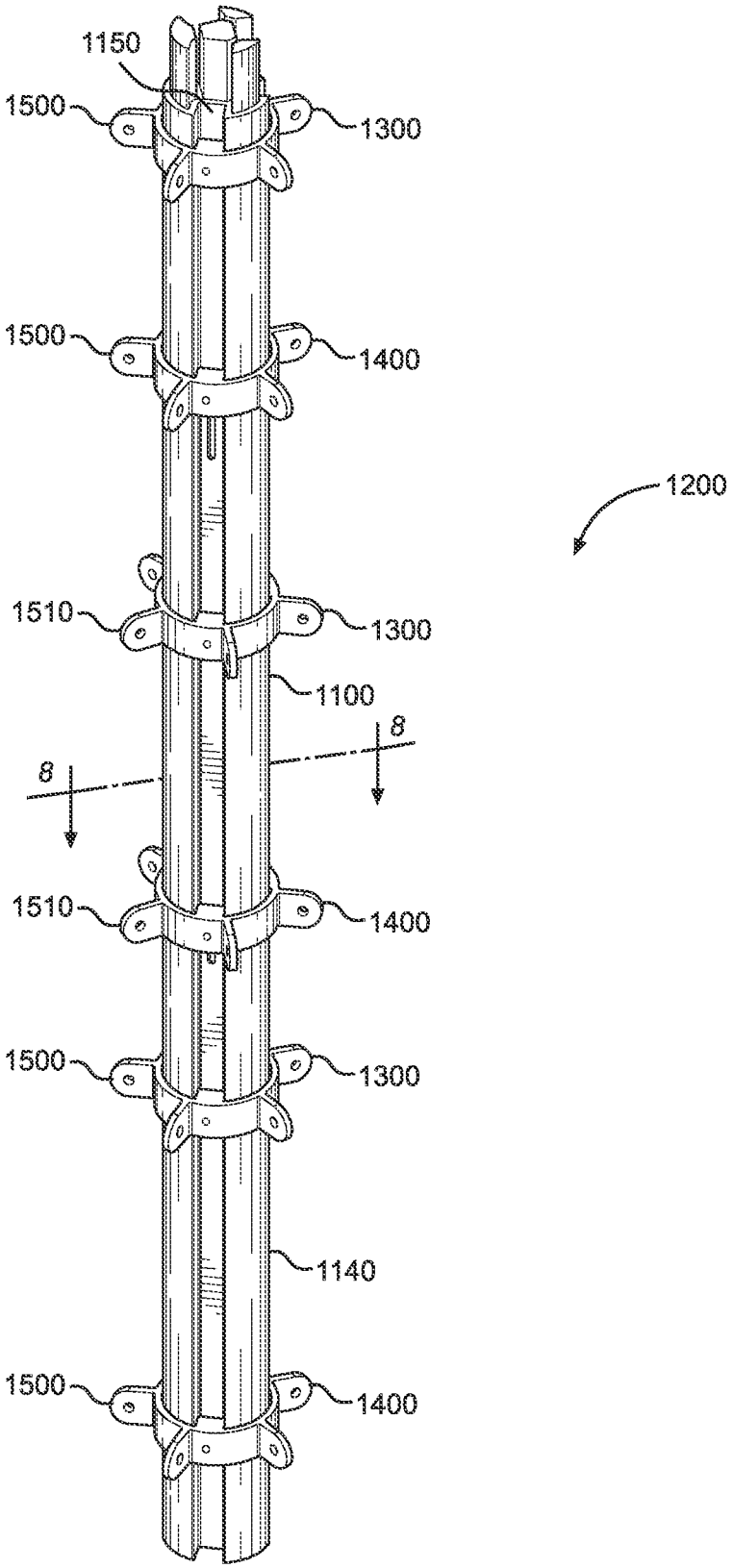

FIG. 5 shows a perspective view of a section of an elongated trunk of the collapsible artificial tree having three sets if first and second collars disposed therearound.

Figure 6:
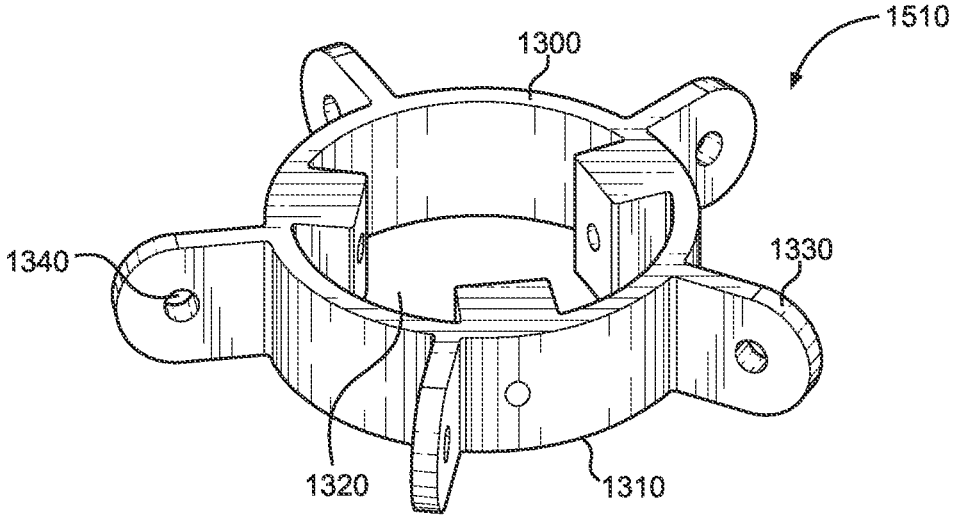

FIG. 6 shows a perspective view of a collar of an embodiment of the collapsible artificial tree.

Figure 7:
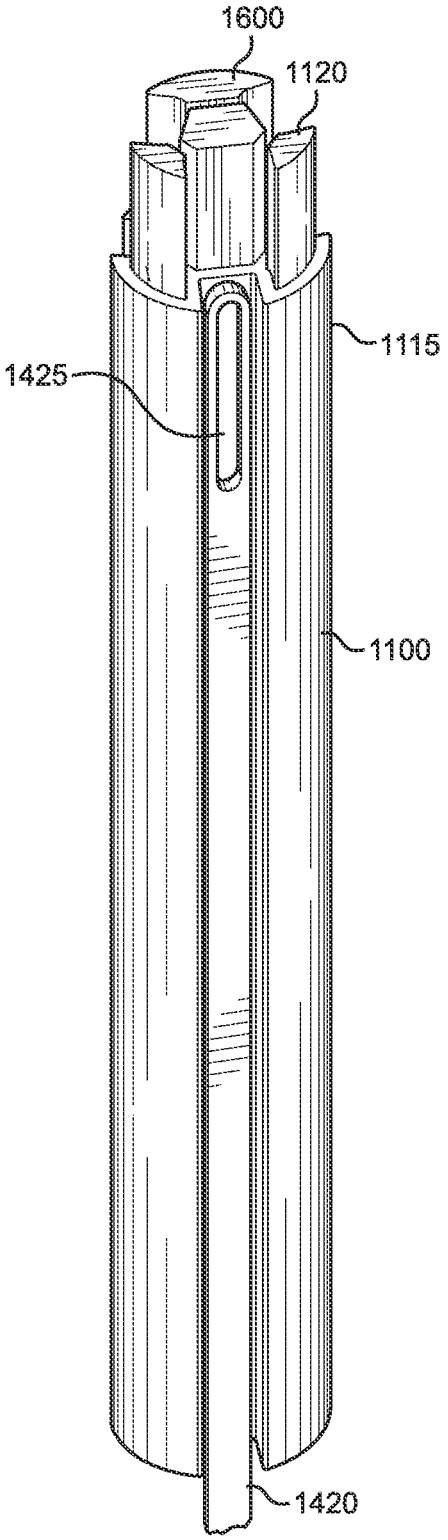

FIG. 7 shows a close-up view of a section of an elongated trunk with a linking bar of an embodiment of the collapsible artificial tree.

Figure 8:
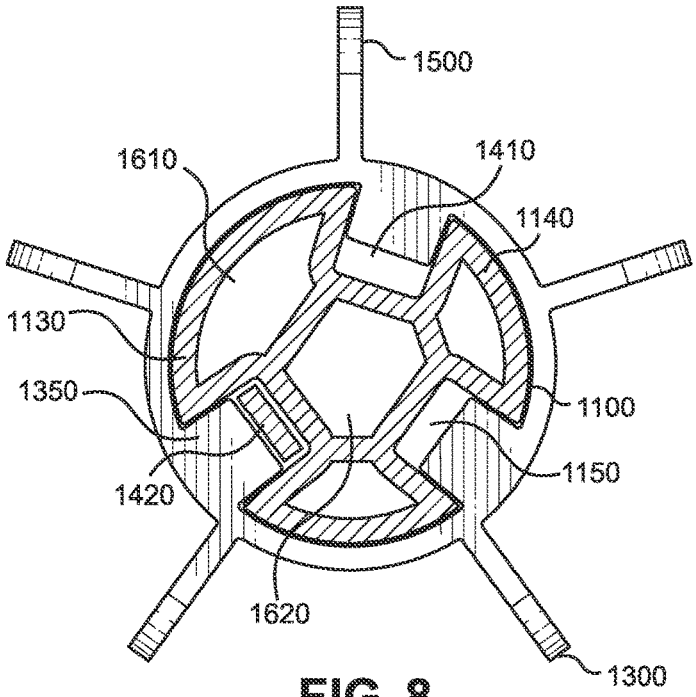

FIG. 8 shows a cross-sectional view of a collar and an elongated trunk of an embodiment of the collapsible artificial tree taken along line 8-8 of FIG. 5.

Figure 9:
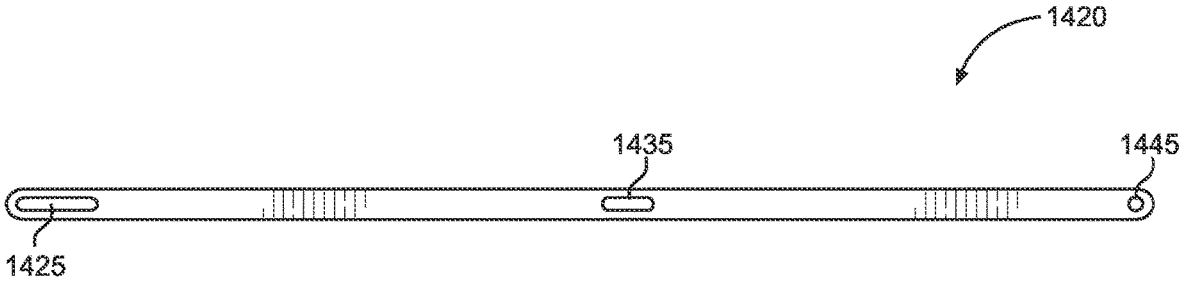

FIG. 9 shows an elevation view a linking bar of an embodiment of the collapsible artificial tree.

Figure 10:
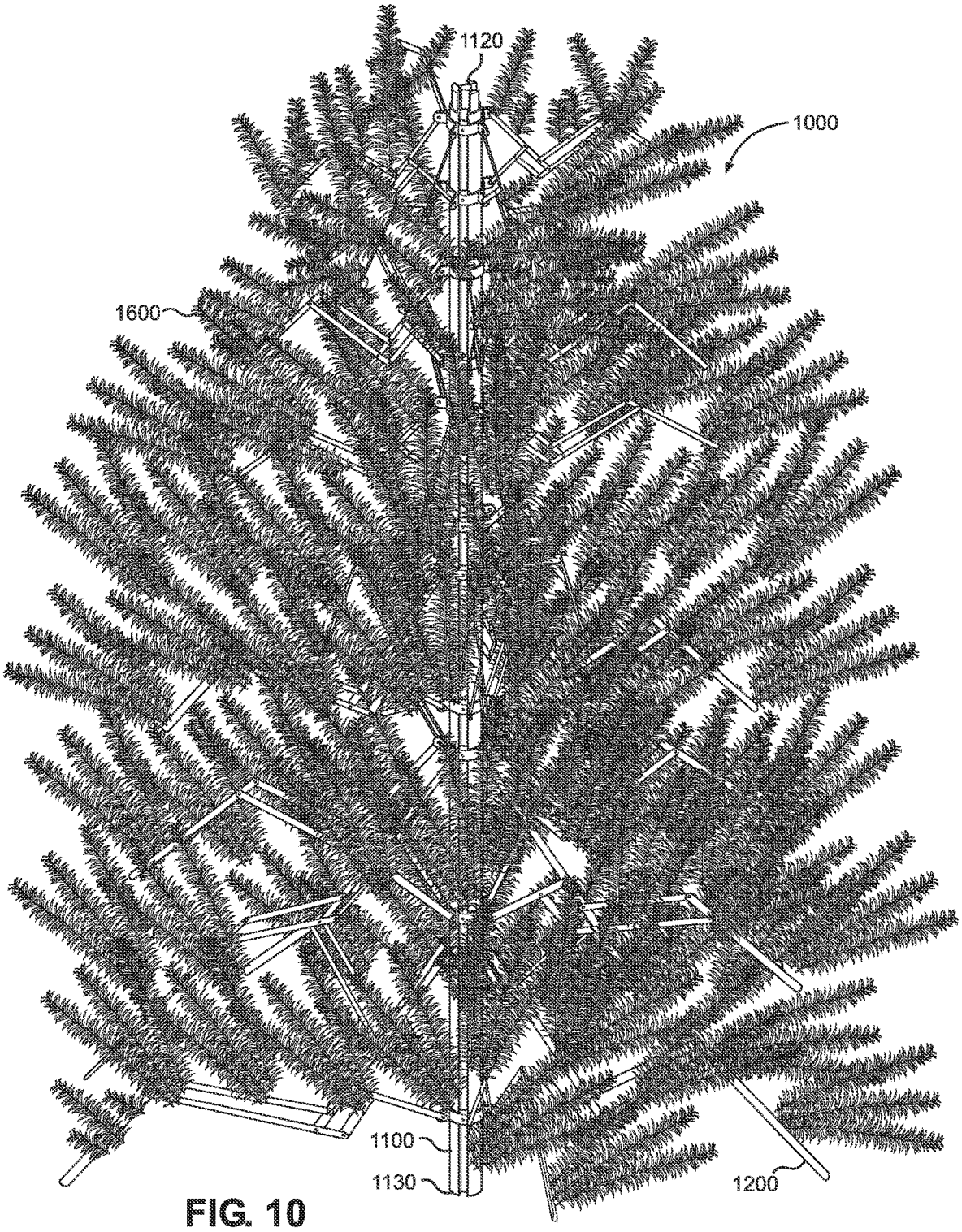

FIG. 10 shows a perspective view of another embodiment of the collapsible artificial tree in an extended configuration.

Figure 11:
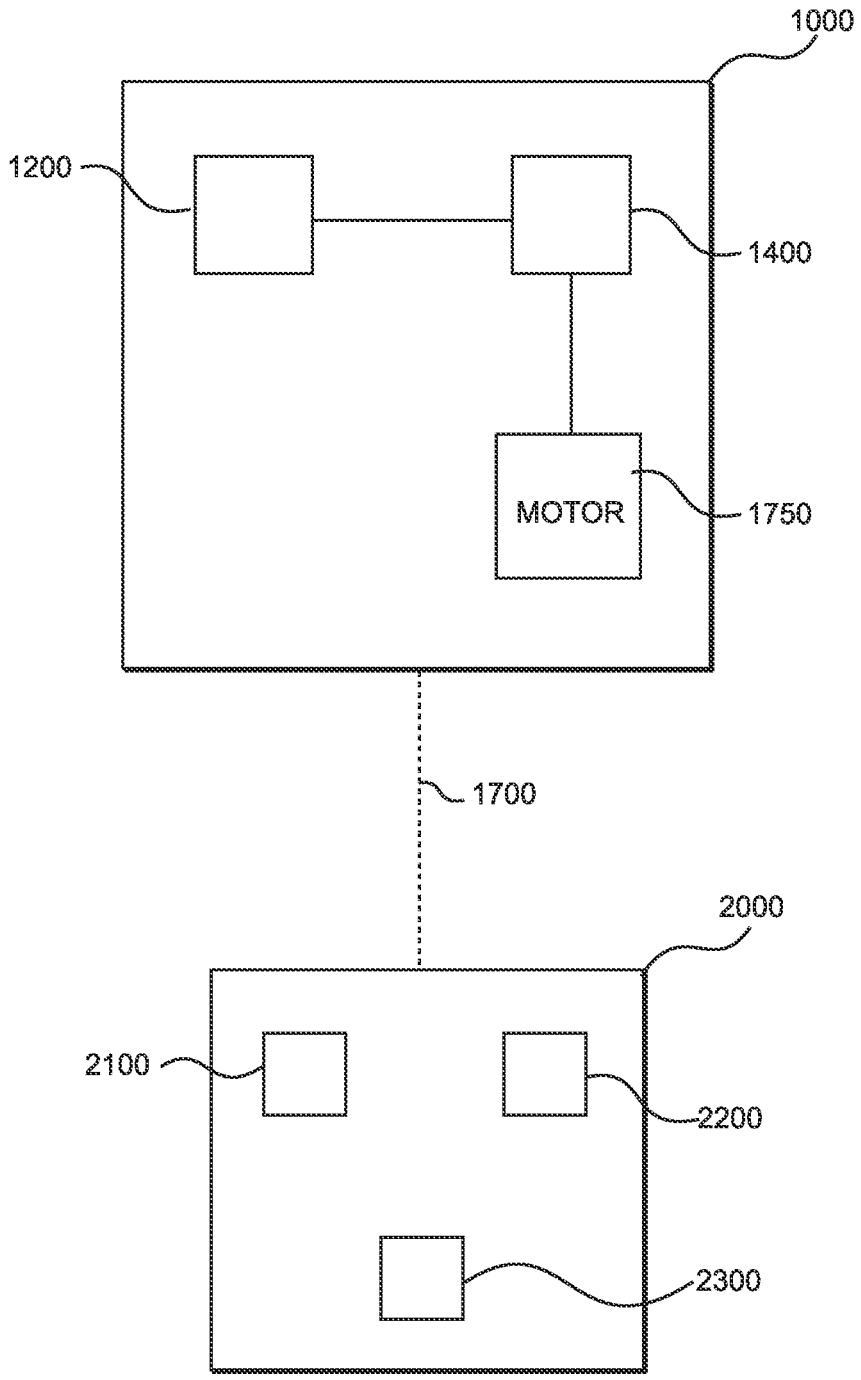

FIG. 11 shows a block diagram of a control circuit of another embodiment of the collapsible artificial tree.

DETAILED DESCRIPTION OF THE INVENTION

Reference is made herein to the attached drawings. For the purposes of presenting a brief and clear description of the present invention, the preferred embodiment will be discussed as used for assembling and moving a collapsible artificial tree between a retracted and extended configuration. The figures and accompanying reference numbers are intended for representative purposes only and should not be considered to be limiting in any respect.

Reference will now be made in detail to the exemplary embodiment (s) of the invention. References to "one embodiment," "at least one embodiment," "an embodiment," "one example," "an example," "for example," and so on indicate that the embodiment(s) or example(s) may include a feature, structure, characteristic, property, element, or limitation but that not every embodiment or example necessarily includes that feature, structure, characteristic, property, element, or limitation. Further, repeated use of the phrase "in an embodiment" does not necessarily refer to the same embodiment.

Figure 1:
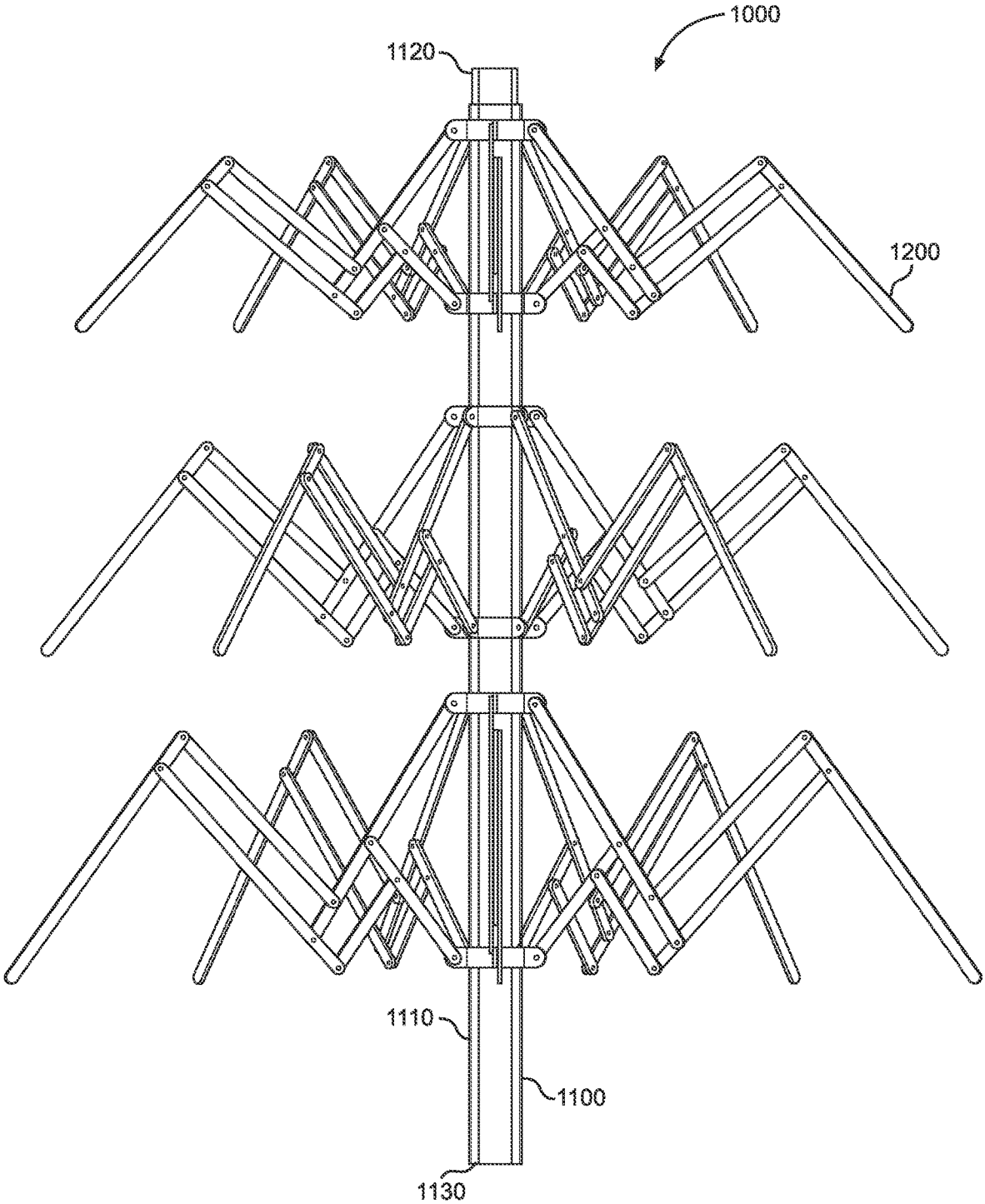
FIG. 1 shows a perspective view of an embodiment of the collapsible artificial tree in an extended configuration.
Figure 2:
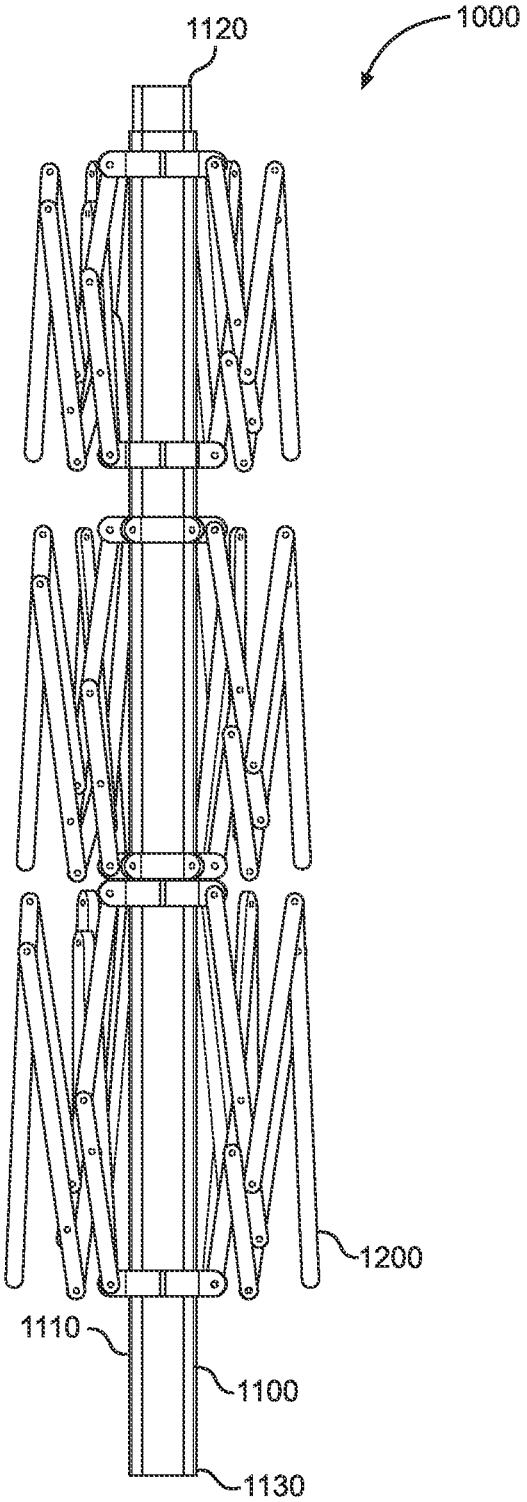
FIG. 2 shows a perspective view of an embodiment of the collapsible artificial tree in a retracted configuration.

Referring now to FIGS. 1 and 2, there are shown perspective views of an embodiment of the collapsible artificial tree in an extended configuration and a retracted configuration, respectively. The collapsible artificial tree 1000 comprises an elongated trunk 1100 having at least one trunk section. In the illustrated embodiment, the elongated trunk 1100 is adjustable in length along the longitudinal axis thereof, allowing the collapsible artificial tree 1000 to fit in rooms with varying ceiling heights. In some embodiments, the trunk sections 1110 are stackable such that a first end 1120 of a first trunk section is adapted to receive a second end 1130 of a second trunk section. In use, the elongated trunk 1100 is disposed in a vertical orientation and, in some embodiments, supported upright by a base. In some embodiments, the base comprises a flat plate adapted to rest flush on a floor surface. However, it is contemplated that in some embodiments any suitable base adapted to support the elongated trunk in an upright position is included or, in alternate embodiments, the collapsible artificial tree does not comprise a base.

The collapsible artificial tree 1000 further comprises one or more branch assemblies 1200 extending from the elongated trunk 1100. In the illustrated embodiment, each branch assembly 1200 extends radially and at fixed intervals along the length of the elongated trunk 1100 and, in some embodiments, spaced at fixed intervals around a horizontal axis of the elongated trunk 1100. In this way, the branch assemblies 1200 resemble branches of a tree. In some embodiments, each branch assembly 1200 comprises artificial foliage to resemble a tree branch. Each branch assembly 1200 is movable between an extended configuration and a retracted configuration.

Figure 3:
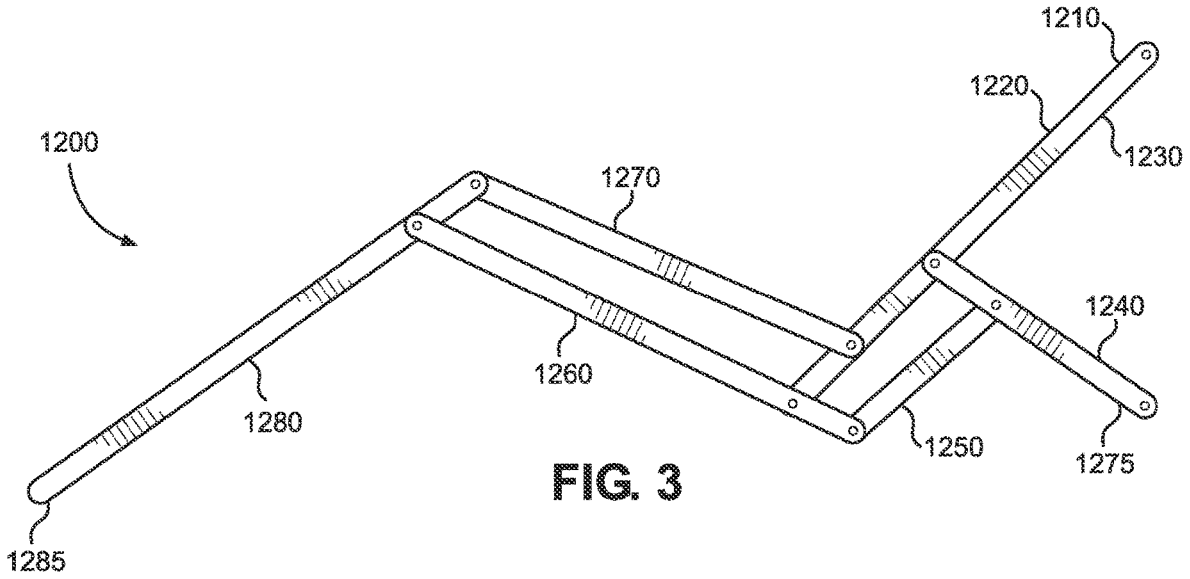
FIG. 3 shows a side view of a first branch assembly of the collapsible artificial tree in an extended configuration.

Referring now to FIGS. 3 and 4, there are shown side views of a branch assembly in an extended configuration and a branch assembly a retracted configuration, respectively. In the illustrated embodiment, each branch assembly 1200 comprises a scissor arm 1210 pivotally connected to the elongated trunk via a first collar and a second collar. The scissor arm 1210 includes a plurality of beam members 1220 pivotally linked to one another via pins 1205. Each beam member 1220 is pivotally secured to one another and operably connected to the first and second collar, such that the movement of the second collar along the elongated trunk causes the branch assembly 1200 to move between the extended and retracted configuration. In the illustrated embodiment, the plurality of beam members 1220 comprises an upper collar support beam 1230, a lower collar support beam 1240, a first intermediate lower beam 1250, a second intermediate lower beam 1260, an upper intermediate beam 1270, and a distal beam 1280. In the illustrated embodiment, the distal beam 1280 comprises the longest length as compared to all of the other beams 1220 of a branch assembly 1200. The upper collar support beam 1230 is the next longest, followed by the second intermediate lower beam 1260, the upper intermediate beam 1270, the lower collar support beam 1240, and then the first intermediate lower beam 1250, which is the shortest of all the beams 1220. The scissor arm 1210 is configured in this way to allow the branch assembly 1200 to retract in the most compact, vertical orientation possible.

In the illustrated embodiment, the upper collar support beam 1230 extends directly from the first collar and is connected on an opposite end to both the second intermediate lower beam 1260 and the upper intermediate beam 1270. The lower collar support beam 1240 extends directly from the second collar and is connected at an opposite end thereof to both the upper collar support beam 1230 and the first intermediate lower beam 1250. The opposite end of the lower collar support beam 1240 is disposed centrally along the upper collar support beam 1230. The first intermediate lower beam 1250 extends between a second end of the lower collar support beam 1240 and a first end of the second intermediate lower beam 1260. The upper intermediate beam 1270 extends between the distal beam 1280 and the upper collar support beam 1230, wherein the distal beam 1280 is also connected to the second intermediate lower beam 1260. The second end of the distal beam 1280 is free and defines the tip of the branch assembly 1200 when fully extended. The first end 1275 of each beam member 1220 is defined as the end closest to the elongated trunk, wherein the second end 1285 of each beam member 1220 is defined as the end furthest from the elongated trunk.

Each beam member 1220 is pivotally connected to an adjoining beam or collar, allowing the branch assembly 1200 to retract and extend. In the illustrated embodiment, the lengths of each beam determine how the branch assembly 1200 retracts and extends, as well as the overall structural appearance of the branch. In the retracted configuration, the plurality of beam members 1220 is oriented generally vertical and adjacent to the elongated trunk for compact storage, as seen in FIG. 2. In the extended configuration, the beam members are offset from one another and generally cascades downward to give the effect of a real branch. In the retracted configuration the scissor arm 1210 is adapted to swing the second end 1285 of the distal beam 1280 along a curvilinear path when transitioning between the retracted and extended configuration. In the extended configuration, the distal beam 1280, the upper collar support beam 1230, and the first intermediate lower beam 1250 are generally parallel to one another, whereas the second intermediate lower beam 1260, the upper intermediate beam 1270, and the lower collar support beam 1240 are generally parallel to one another and extending substantially perpendicularly to the other beams 1220.

Referring now to FIGS. 5 and 6, there is shown a perspective view of a section of an elongated trunk of the collapsible artificial tree having three sets of first and second collars disposed therearound and a perspective view of a collar of an embodiment of the collapsible artificial tree, respectively. The collapsible artificial tree comprises a first collar 1300 and a second collar 1400 disposed in a stacked configuration along the elongated trunk 1100. The collars 1300, 1400 are composed of rigid rings that secure around the elongated trunk 1100. In the illustrated embodiment, the first collar 1300 is adapted to remain secured to the elongated trunk 1100 and the second collar 1400 is slidably engaged with the elongated trunk 1100. In alternate embodiments, the first collar is slidably engaged with the trunk and the second collar is fixed in position. As the second collar 1400 slides towards the first collar 1300, the branch assembly extends outward from the elongated trunk 1100 to the extended configuration and as the second collar 1400 slides away from the first collar 1300, the branch assembly retracts to the retracted configuration.

Each collar 1300, 1400 comprises an annular ring 1310 having a central channel 1320 adapted to receive the elongated trunk 1100 therein. In the illustrated embodiment, the collar 1300, 1400 comprises at least three mounting points 1330 each adapted to removably fasten to a branch assembly via a pin. In some embodiments, the three mounting points 1330 are positioned equidistant along an exterior perimeter of the annular ring 1310. In the illustrated embodiment, the mounting points 1330 are tabs that extend outward from the ring, wherein each mounting point comprises an aperture 1340 configured to receive a pin to mount either the upper or lower collar support beam thereto depending upon if it is a first collar or second collar.

In the illustrated embodiment, there are a plurality of different collar configurations. The difference in configurations allows for a branch assembly on one tier to be offset from a branch assembly on an adjacent tier, above or below, to cause the branch assemblies to lay in a more natural pattern. Each set of first and second collars connected to a single branch assembly comprises a same collar configuration. A first collar configuration 1500 comprises mounting points 1330 that are offset from mounting points 1330 of a second collar configuration 1510, as seen in FIG. 5. In the illustrated embodiment, two collar configurations are shown 1500, 1510 alternating between each set of first and second collars 1300, 1400. However, in alternate embodiments, the collapsible artificial tree comprises three or more collar configurations.

Referring now to FIGS. 7-9, there is shown a close-up view of a section of an elongated trunk with a linking bar of an embodiment of the collapsible artificial tree, a cross-sectional view of a collar and an elongated trunk of an embodiment of the collapsible artificial tree taken along line 8-8 of FIG. 5, and an elevation view a linking bar of an embodiment of the collapsible artificial tree, respectively. In the illustrated embodiment, the elongated trunk 1100 comprises one or more flanges 1140 that extend along a longitudinal axis of the trunk 1100 that form elongated slots 1150 between each pair of adjacent flanges 1140. The flanges 1140 and elongated slots 1150 extend from the first end of a trunk section to the second end thereof. In the illustration embodiment, an exterior side of the flanges 1140 are curved to abut the interior side of each ring-shaped collar. In the shown embodiment, the elongated trunk comprises a first, second, and third flange 1140, wherein the first and second flanges comprise same dimensions and the third flange comprises a larger width, wherein the width is measured along the horizontal axis thereof. The difference in width of the third flange is to serve as a guide when assembling the trunk sections to ensure proper alignment of the collars and branch assemblies.

The second collar 1400 comprises an internal facing key 1350 that is adapted to fit within the elongated slot 1150 to prevent rotation about the elongated trunk 1100 and provide for sliding along the longitudinal axis of the trunk 1100. In the illustrated embodiment, the internal facing key 1350 comprises three block members having a substantially same width as the corresponding three elongated slots 1150. In some embodiments, internal facing key 1350 may have a rectangular, trapezoidal, or triangular cross section.

A gap 1410 is formed within the elongated slot 1150 between the key 1350 and elongated trunk 1100 when the collar 1300 is in sliding arrangement with the elongated trunk 1100. The gap 1410 is sized to receive a linking bar 1420, wherein the linking bar 1420 is adapted to operably connect and simultaneously move multiple sets of first and second collars between the extended and retracted configurations. The linking bar 1420 comprises an elongated first groove 1425 having a length, wherein at least one of the collars is secured to the elongated trunk 1100 via a fastener extending through the internal facing key 1350 and the first groove 1425. The linking bar 1420 is adapted to actuate more than one branch assemblies positioned at different tiers between the extended configuration and the retracted configuration. The first groove 1425 defines the extended configuration and the retracted configuration. The first collar is fixed to the elongated trunk and remains fixed as the second collar reciprocates between the retracted and extended configurations via the linking bar 1420.

The linking bar 1420 further comprises a second and third groove each adapted to engage with a collar on a different tier. The first groove comprises a length greater than the other grooves, followed by the second groove, and then the third groove having the smallest length of the three grooves. This is due to the first groove secured to a tier higher than the other two tiers, wherein the branch assemblies are shorter than the branch assemblies at a lower tier. The linking bar 1420 must move a length within the elongated slot to fully retract and extend the branch assemblies to identical configurations. However, since the upper branch assemblies are shorter, the distance required to fully retract and extend the scissor arm is less than the distance required for a lower tiered branch assembly. Therefore, the grooves must be lengthier as the tiers become higher to account for the greater distance the linking bar 1420 must move for the lower tiered branch assemblies.

The first end 1120 of the trunk section 1115 comprises a male connector 1600 that is insertable into a female connector 1610 of the second end 1130 of another trunk section. In the illustrated embodiment, the female connector 1610 comprises a channel extending through each flange 1140 and a center recess 1620 of the trunk section 1115, wherein the male connector 1600 comprises protrusions having a same cross-sectional shape as the channels and the center recess. In this way, the trunk sections 1115 are stackable to form an elongated trunk 1100 of a desired length. In the illustrated embodiment, the trunk sections 1115 comprise varying lengths. However, in alternate embodiments, each trunk section comprises a same length.

Referring now to FIG. 10, there is shown a perspective view of another embodiment of the collapsible artificial tree in an extended configuration. In some embodiments, the second collar is configured to be moved manually upwards and downwards along the trunk 1100 by a user. In other embodiments, all of the second collars are operably connected to one another such that moving one of the second collars of the collapsible artificial tree 1000 moves all second collars.

In the illustrated embodiment, the branch assemblies 1200 each comprise different lengths from one another such that when disposed on the elongated trunk 1100 in an extended configuration the branch assemblies 1200 ascend in length from a base and upwards along the trunk 1100. In this way, the collapsible artificial tree 1000 resembles an evergreen conifer, such as a spruce, pine or fir. In the illustrated embodiment, as the branch assemblies 1200 are disposed further away from the lower end of the trunk, the distance between the first and second collars decreases due to the decrease in overall length of the respective branch assembly 1200.

In one embodiment, the present invention relates to a collapsible artificial tree that mimics the appearance of a real tree when in an extended configuration and collapses via movement of by the movement of the branch assemblies to a retracted configuration for compact storing. Movement of the lower collar along the elongated trunk and towards the upper collar results in the expansion of the tree structure. The success of this collapsible system not only relies upon the sliding collars, but also the branch assembly structure. The branch assembly configuration maintains a free end on the distal beam and forms the branch-like structure. Such a structure provides for efficient assembly and compact storage. Moreover, the adjustable size of the trunk allows for ease of customization.

Referring now to FIG. 11, there is shown a block diagram of a control circuit of an embodiment of the collapsible artificial tree. In the illustrated embodiment, the collapsible artificial tree 1000 comprises an actuator 1750 operably connected to the second collar 1400 and adapted to transition the one or more branch assemblies 1200 between the extended and retracted configuration by sliding the second collar 1400 along a longitudinal axis of the elongated trunk. In some embodiments, the actuator is a motor operably connected to one or more of the second collars 1400 and is configured to automatically move the second collar between the extended and retracted configuration when activated. In some embodiments, the motor is operably connected to a remote 2000 that allows a user to selectively retract and extend the branch assemblies upon actuation of the remote. The remote 2000 is wirelessly 1700 connected to the actuator, wherein some embodiments, the remote is wired to the actuator. The remote 2000 allows a user to activate 2100 the collapsible artificial tree 1000 and selectively extend 2200 or retract 2300 the branch assemblies.

It is therefore submitted that the instant invention has been shown and described in what is considered to be the most practical and preferred embodiments. It is recognized, however, that departures may be made within the scope of the invention and that obvious modifications will occur to a person skilled in the art. With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A collapsible artificial tree, comprising:

one or more branch assemblies extending from an elongated trunk, each branch assembly adapted to transition between an extended and retracted configuration;

a first and second collar in engagement with the trunk, wherein the second collar is in sliding arrangement with the trunk;

each branch assembly comprising:

a scissor arm pivotally connected to the first and second collars, wherein the scissor arm further comprises a plurality of beam members pivotally linked by pivot pins;

wherein the retracted configuration, the plurality of beam members is oriented generally vertical to the elongated trunk;

wherein as the second collar slides towards the first collar, the branch assembly extends outward from the elongated trunk to the extended configuration;

wherein the collars are adapted to connect to a plurality of branch assemblies:

wherein each collar comprises an annular ring having a central channel adapted to receive the elongated trunk therein and at least three mounting points each adapted to removably fasten to a branch assembly;

wherein the three mounting points are positioned equidistant along an exterior perimeter of the annular ring.

2. The collapsible artificial tree of claim 1, wherein each branch assembly is only connected to the collar via a collar pivot pin.

3. The collapsible artificial tree of claim 1, wherein the elongated trunk is adapted to adjust a length thereof along a longitudinal axis.

4. The collapsible artificial tree of claim 1, wherein the collars are positioned at fixed tiers along the elongated trunk.

5. The collapsible artificial tree of claim 4, wherein the one or more branch assemblies comprise an upper and lower branch assembly having different lengths between the elongated trunk and a distalmost point of the plurality of beams in the extended configuration.

6. The collapsible artificial tree of claim 1, wherein the elongated trunk comprises one or more flanges that extend along a longitudinal axis of the trunk that form elongated slots.

7. The collapsible artificial tree of claim 6, wherein the second collar comprises an internal facing key that is adapted to fit within the elongated slot to prevent rotation about the elongated trunk and provide for sliding along the longitudinal axis of the trunk.

8. The collapsible artificial tree of claim 7, wherein a gap is formed within the elongated slot between the key and elongated trunk when the collar is in sliding arrangement with the elongated trunk, the gap is sized to receive a linking bar.

9. The collapsible artificial tree of claim 8, wherein the linking bar comprises an elongated groove having a length, wherein at least one of the collars is secured to the elongated trunk via a fastener extending through the internal facing key and the elongated groove.

10. The collapsible artificial tree of claim 9, wherein the linking bar is adapted to actuate more than one branch assemblies positioned at different tiers between the extended configuration and the retracted configuration.

11. The collapsible artificial tree of claim 9, wherein the elongated groove defines the extended configuration and the retracted configuration.

12. The collapsible artificial tree of claim 11, wherein the first collar is fixed to the elongated trunk and remains fixed as the second collar reciprocates between the retracted and extended configurations.

13. The collapsible artificial tree of claim 1, wherein the plurality of beam members comprises an upper collar support beam, a lower collar support beam, a first intermediate lower beam, a second intermediate lower beam, an upper intermediate beam, and a distal beam.

14. The collapsible artificial tree of claim 13, wherein the plurality of beams of the scissor arm further comprises:

an upper collar support beam extends directly from the first collar and the lower collar support beam extends directly from the second collar at a first end and connected to the upper collar support beam at a second end thereof;

the first intermediate lower beam extends between a second end of the lower collar support beam and a first end of the second intermediate lower beam;

the upper intermediate beam extends between the distal beam and the upper collar support beam;

the distal beam is also connected to the second intermediate lower beam and joined to the upper intermediate beam at the first end thereof, wherein the second end of the distal beam is free and defines the tip of the branch assembly when fully extended.

15. The collapsible artificial tree of claim 14, wherein the retracted configuration the scissor arm is adapted to swing the second end of the distal beam along a curvilinear path when transitioning between the retracted and extended configuration.

16. The collapsible artificial tree of claim 1, further comprising an actuator operably connected to the second collar and adapted to transition the one or more branch assemblies between the extended and retracted configuration by sliding the second collar along a longitudinal axis of the elongated trunk.

17. The collapsible artificial tree of claim 16, wherein the actuator is operably connected to a wireless remote.

18. A collapsible artificial tree, comprising:

one or more branch assemblies extending from an elongated trunk, each branch assembly adapted to transition between an extended and retracted configuration;

a first and second collar in engagement with the trunk, wherein the second collar is in sliding arrangement with the trunk;

each branch assembly comprising:

a scissor arm pivotally connected to the first and second collars, wherein the scissor arm further comprises a plurality of beam members pivotally linked by pivot pins;

wherein the retracted configuration, the plurality of beam members is oriented generally vertical to the elongated trunk;

wherein as the second collar slides towards the first collar, the branch assembly extends outward from the elongated trunk to the extended configuration;

wherein the plurality of beam members comprises an upper collar support beam, a lower collar support beam, a first intermediate lower beam, a second intermediate lower beam, an upper intermediate beam, and a distal beam.

* * * * *